United States Patent [19]

Smith

[11] 4,090,951

[45] May 23, 1978

[54] DENITROGENATION OF SYNCRUDE

[75] Inventor: Robert H. Smith, Plano, Tex.

[73] Assignee: Atlantic Richfield Company, Los Angeles, Calif.

[21] Appl. No.: 803,833

[22] Filed: Jun. 6, 1977

[51] Int. Cl.[2] ..... C10G 25/12; C10G 23/00

[52] U.S. Cl. ..... 208/91; 208/254 R; 208/254 H

[58] Field of Search ..... 208/254 R, 91, 254 H

[56] References Cited

U.S. PATENT DOCUMENTS

| | | | |
|---|---|---|---|
| 2,744,053 | 5/1956 | Kay et al. | 208/254 R |
| 2,962,435 | 11/1960 | Fleck et al. | 208/254 R |
| 2,984,620 | 5/1961 | Fleck et al. | 208/254 R |
| 3,189,539 | 6/1965 | Sieg | 208/91 |

*Primary Examiner*—George Crasanakis
*Attorney, Agent, or Firm*—Roderick W. MacDonald

[57] ABSTRACT

A method for reducing the nitrogen content of a syncrude feed obtained from at least one of oil shale, tar sands, and coal wherein syncrude is mixed with an adsorbent which is effective for adsorbing nitrogen materials from the syncrude feed and also effective as a catalytic cracking catalyst for said syncrude feed. The mixture is settled into a first phase of low nitrogen syncrude material and a second phase of adsorbent and high nitrogen syncrude feed. The first phase can be subjected to additional light or mild hydrotreating, i.e. low temperature, high space velocity, etc. The second phase is stripped to separate low nitrogen syncrude material which is combined with the hydrotreated low nitrogen material to form a first low nitrogen syncrude product. The stripped second phase is catalytically cracked to produce a second low nitrogen syncrude product. The adsorbent from the cracking step is regenerated by heating to at least 1000° F in the presence of air or oxygen and the regenerated adsorbent is used either in the mixing step or the cracking step of the process.

5 Claims, 2 Drawings

DENITROGENATION OF SYNCRUDE

BACKGROUND OF THE INVENTION

Hydrocarbonaceous liquids obtained from tar sands, coal, and oil shale generally contain relatively high quantities of nitrogen in various forms, generally five and six member cyclic compounds such as pyridines and indoles. It is desirable in a number of cases to reduce the nitrogen content of such syncrude materials, particularly if they are to be used as fuel.

SUMMARY OF THE INVENTION

According to this invention syncrude feed containing nitrogen is mixed with at least one material which is effective both to adsorb nitrogen compounds from the syncrude feed and to serve as a catalytic cracking catalyst for said syncrude feed, the mixing of said adsorbent with the feed helping form two phases, a first phase composed essentially of a first low nitrogen syncrude product and the second phase composed essentially of the adsorbent and high nitrogen syncrude feed. The second phase is subjected to catalytic cracking conditions which produce a second low nitrogen syncrude product.

Accordingly, it is an object of this invention to provide a new and improved method for processing syncrude material. It is another object to provide a new and improved method for denitrogenation of syncrude feed.

Other aspects, objects and advantages of this invention will be apparent to those skilled in the art from this disclosure and the appended claims.

DETAILED DESCRIPTION OF THE INVENTION

Figure 1:
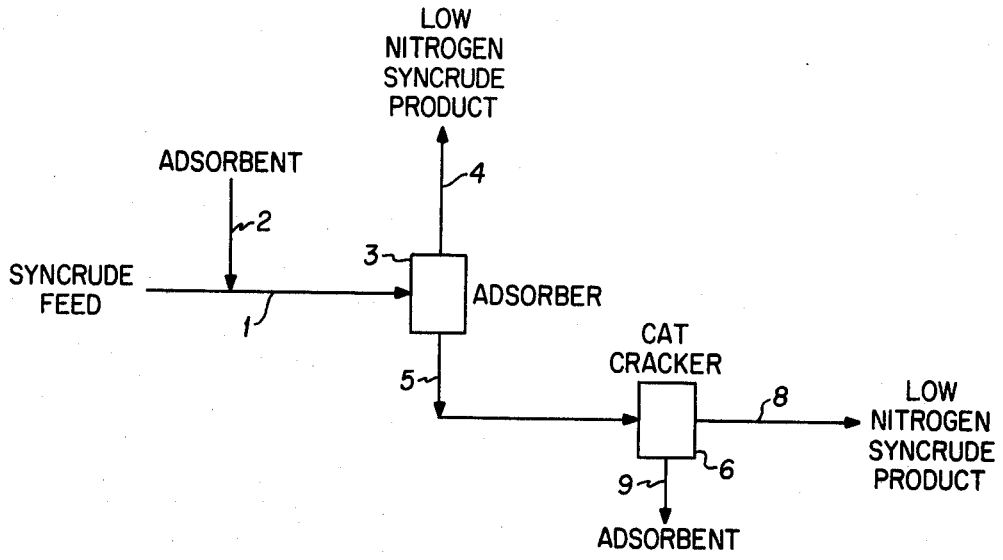
FIG. 1 shows a process embodiment within this invention wherein the syncrude feed is first mixed with adsorbent whereafter a separation step is carried out. The adsorbent and high nitrogen syncrude mixture is separated out and then subjected to catalytic cracking to form additional low nitrogen syncrude product.

FIG. 1 shows syncrude feed in pipe 1 which feed is at least one hydrocarbonaceous liquid (full range or one or more cuts thereof) obtained from tar sands, normally solid coal, and/or oil shale, i.e., syncrude. This feed contains an amount of nitrogen that is to be reduced. Depending upon the desired use of the syncrude product, the syncrude feed stream can contain widely varying amounts of nitrogen, e.g., from about 10 ppm to about 10 weight percent. That is to say that the initial quantity of nitrogen in the syncrude feed can be any amount, including that which initially appears to be quite low. However, whatever the initial amount of nitrogen is, for widely varying reasons, the amount, no matter how low, is desirably reduced for some sort of ultimate reason.

The feed in pipe 1 is mixed with an adsorbent by way of pipe 2 and the mixture then passes into adsorber 3. A mixing chamber can be employed if desired.

The adsorbent is employed in the feed in pipe 1 in an amount effective to serve both to adsorb nitrogen compounds and later to serve as a catalyst for the feed present in the catalytic (cat) cracking unit. The adsorbent can be any material which serves the above double requirement, and, preferably selected from the group consisting of acid treated alumino-silicates, amorphous synthetic silica-alumina and crystalline silica-alumina, as is well known in the art and described in greater detail in *Catalytic Processes and Proven Catalysts* by Charles L. Thomas, Academic Press, New York, 1970. Of course, mixtures of two of more of such materials can be employed in this invention. The adsorbent is generally employed in an amount of at least about 5 weight percent based on the total weight of the syncrude feed to which it is added, the maximum amount of adsorbent employed being dictated only by economics and not by operability of the process.

The syncrude feed and adsorbent are mixed in pipe 1 as well as in adsorber 3 at ambient conditions of temperature and pressure and for a time sufficient to allow formation of said two phases, the first phase being essentially a low nitrogen syncrude product and the second phase being a mixture essentially of adsorbent and high nitrogen syncrude. The low nitrogen syncrude product generally contains at least 20% lower nitrogen concentration than the high nitrogen feed in the second phase.

The first phase is removed from the adsorber by way of pipe 4 while the second phase is separately removed from adsorber 3 by way of pipe 5 and passed through cat cracker 6.

In cat cracker 6 a mixture of adsorbent and high nitrogen syncrude is subjected to cracking conditions of from about 650° to about 1000° F. The residence time is sufficient to crack the hydrocarbonaceous materials present and form a low nitrogen syncrude product which also has a nitrogen content at least 20 weight percent lower than that of the high nitrogen syncrude material in pipe 5. This additional low nitrogen syncrude product formed in cat cracker 6 is removed by way of pipe 8 for use as desired, including, but not limited to, combination with the product in pipe 4.

Adsorbent is separately removed from cat cracker 6 by way of pipe 9.

Figure 2:
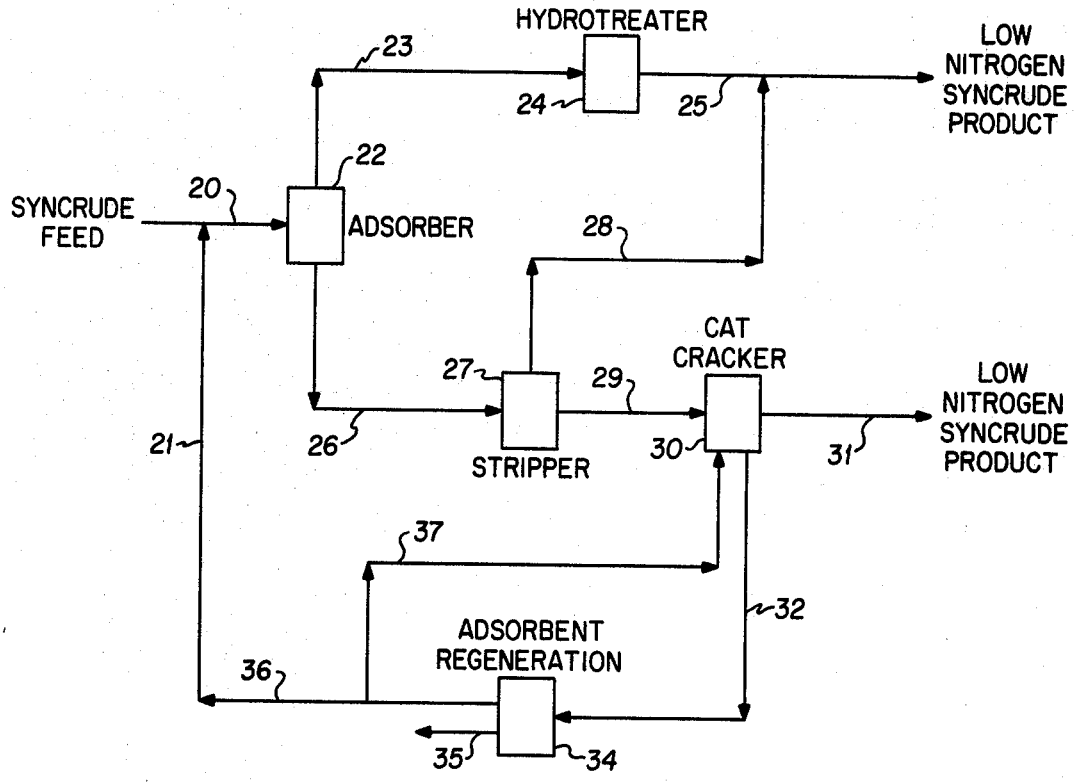
FIG. 2 shows another embodiment within this invention similar to the process of FIG. 1 except that FIG. 2 shows an intermediate stripping step between the separation and cracking step, and the regeneration and recovery of used adsorbent.

FIG. 2 shows syncrude feed in pipe 20 being mixed with adsorbent from pipe 21 and then passing into adsorber 22.

From adsorber 22 there is recovered by way of pipe 23 a low nitrogen syncrude material which, optionally, can be subjected to additional light or mild hydrotreating in hydrotreater 24 to further reduce the nitrogen content of that material. The low in nitrogen syncrude product obtained from hydrotreater 24 by way of pipe 25 is a product of the process.

A mixture of adsorbent and high nitrogen syncrude removed from adsorber 22 by way of pipe 26 is passed to a stripper such as a steam stripper 27 wherein additional low nitrogen syncrude material is stripped from the feed mixture and passed by way of pipe 28 to pipe 25 to provide additional product of the process. The stripped mixture of adsorbent and high nitrogen syncrude material is passed by way of pipe 29 to cat cracker 30 wherein the mixture is exposed to cat cracking conditions as aforesaid. In cracker 30 the high nitrogen syncrude material is cracked to produce a low nitrogen syncrude material which is recovered by way of pipe 31 and which can be, if desired, combined with the material in pipe 25. The adsorbent which served as a hydrocracking catalyst in unit 30 is separately removed from that unit by way of pipe 32 and passed to regeneration unit 34.

In regeneration unit 34 the adsorbent is subjected to a temperature of at least 1000° F in the presence of air or oxygen to drive off nitrogen compounds which are recovered by way of pipe 35 and to burn off carbon that was deposited on the adsorbent during prior processing such as in cracker 30. The regenerated adsorbent is removed from unit 34 by way of pipe 36 and can be returned to cat cracker 30 by way of pipe 37 or passed to pipe 21 for mixing with fresh incoming syncrude feed or both as desired.

Catalytic cracking is well known in the art and any conventional catalytic cracking process is applicable to this invention, the same applying to hydrotreating, e.g., that disclosed in U.S. Pat. No. 4,003,829, the disclosure of which is incorporated herein by reference. As regards hydrotreating unit 24, only light hydrotreating is necessary, i.e., low temperature, high space velocity, and the like, since the product in pipe 23 is already a low nitrogen material. All of the details and requirements necessary for the above-described hydrotreating and catalytic cracking steps will be readily known to one skilled in the art.

EXAMPLE

A process is carried out similar to that shown in FIG. 1 wherein a shale oil feed containing 2.17 weight percent nitrogen is mixed with an adsorbent, which is a commercial synthetic zeolite cracking catalyst composed of aluminosilicates. Equal weights of the adsorbent and shale oil feed were mixed at conditions of 350° F and atmospheric pressure and allowed to set in an adsorber for 15 minutes at essentially quiescent conditions. After separation of the solid adsorbent from the mixture, a low nitrogen syncrude phase remains which contains 1.35 weight percent of nitrogen and essentially no adsorbent. The adsorbent contains high nitrogen syncrude containing 4.50 weight percent nitrogen.

The adsorbent-high nitrogen syncrude phase mixture is separately subjected to cracking conditions of 925° F, 10 psig, and a weight hourly space velocity of 1.0 lbs. feed oil per lb. of catalyst per hour. During this catalytic cracking step the high nitrogen syncrude is cracked and denitrogenated to form a low nitrogen syncrude produce containing at least 10 weight percent less nitrogen than in adsorbent containing high nitrogen syncrude and is removed as an additional product of the process separate from the adsorbent catalyst present in the cat cracker.

Reasonable variations and modifications are possible within the scope of this disclosure without departing from the spirit and scope of this invention.

The embodiments of the invention in which an exclusive property or privelege is claimed are defined as follows:

1. A method for reducing the nitrogen content of a syncrude feed obtained from at least one of oil shale, tar sands, and coal, comprising mixing an adsorbent with said feed, said adsorbent being effective for and being employed in an amount effective to adsorb nitrogen materials from said syncrude feed and also to serve as a catalytic cracking catalyst for said syncrude feed, settling said mixture to form a first phase composed essentially of a low nitrogen syncrude material, and a second phase composed of said adsorbent and high nitrogen syncrude feed, separating said first and second phases from one another, hydrotreating said first phase to reduce the nitrogen content of said low nitrogen material, stripping low nitrogen syncrude material from said second phase, combining said material stripped from said second phase with said hydrotreated low nitrogen material to form a first low nitrogen syncrude product catalytically cracking said stripped second phase to produce a second low nitrogen syncrude product, recovering adsorbent from said cracking step, regenerating said recovered adsorbent by heating same at a temperature of at least 1000° F in the presence of air or oxygen to drive off nitrogen compounds and burn off at least part of the carbon previously deposited on said adsorbent, and reusing at least part of said regenerated adsorbent in the process.

2. The method according to claim 1 wherein said adsorbent is selected from the group consisting of silica, alumina, silica alumina and mixtures thereof.

3. the method according to claim 1 wherein said adsorbent is employed in an amount of at least 5 weight percent based on the total weight of said syncrude feed.

4. The method according to claim 1 wherein said catalytic cracking is carried out at a temperature of from about 650° to about 1000° F.

5. The method according to claim 1 wherein said adsorbent is an aluminosilicate.

* * * * *